US009288884B2

(12) United States Patent
Nakagomi et al.

(10) Patent No.: US 9,288,884 B2
(45) Date of Patent: Mar. 15, 2016

(54) DISCHARGE LAMP LIGHTING DEVICE, DISCHARGE LAMP LIGHTING METHOD, AND PROJECTOR

(71) Applicant: SEIKO EPSON CORPORATION, Tokyo (JP)

(72) Inventors: Yoichi Nakagomi, Matsumoto (JP); Tetsuo Terashima, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 300 days.

(21) Appl. No.: 14/134,269

(22) Filed: Dec. 19, 2013

(65) Prior Publication Data

US 2014/0191685 A1 Jul. 10, 2014

(30) Foreign Application Priority Data

Jan. 7, 2013 (JP) ..... 2013-000368
Nov. 13, 2013 (JP) ..... 2013-234709

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/292*** | (2006.01) |
| ***H05B 41/288*** | (2006.01) |

(52) U.S. Cl.

CPC ..... *H05B 41/2928* (2013.01); *H05B 41/2882* (2013.01)

(58) Field of Classification Search

USPC ..... 315/307

See application file for complete search history.

(56) References Cited

U.S. PATENT DOCUMENTS

| | | | | |
|---|---|---|---|---|
| 2007/0018591 | A1* | 1/2007 | Noguchi | H05B 41/2882 315/308 |
| 2010/0156324 | A1* | 6/2010 | Nagase | H05B 33/089 315/307 |
| 2011/0025233 | A1* | 2/2011 | Morales | H05B 41/382 315/307 |
| 2011/0037401 | A1* | 2/2011 | Yu | H05B 33/089 315/246 |
| 2012/0068626 | A1* | 3/2012 | Lekatsas | H05B 33/0815 315/307 |
| 2012/0169255 | A1* | 7/2012 | Giussani | H05B 41/2983 315/307 |
| 2012/0223650 | A1* | 9/2012 | Radermacher | H05B 37/0254 315/200 R |
| 2013/0169191 | A1* | 7/2013 | Ootsuka | H05B 33/0815 315/308 |
| 2013/0271040 | A1* | 10/2013 | Chen | H05B 33/0815 315/307 |
| 2014/0139603 | A1* | 5/2014 | Fujita | H01S 5/0427 347/118 |
| 2014/0265935 | A1* | 9/2014 | Sadwick | H05B 33/0848 315/307 |
| 2015/0022120 | A1* | 1/2015 | Ko | H05B 33/089 315/307 |
| 2015/0351180 | A1* | 12/2015 | Choe | H05B 33/0815 315/201 |

FOREIGN PATENT DOCUMENTS

| | | |
|---|---|---|
| JP | A-9-232091 | 9/1997 |
| JP | A-2004-39397 | 2/2004 |
| JP | A-2007-194073 | 8/2007 |

* cited by examiner

*Primary Examiner* — Adam Houston
(74) *Attorney, Agent, or Firm* — Oliff PLC

(57) ABSTRACT

A discharge lamp lighting method for controlling lighting of a discharge lamp includes varying an amount of generation (current value) of overshoot and undershoot generated in a waveform of a drive current that is applied when driving the discharge lamp, according to a magnitude of drive power supplied to the discharge lamp and a drive mode.

20 Claims, 5 Drawing Sheets

DISCHARGE LAMP LIGHTING DEVICE, DISCHARGE LAMP LIGHTING METHOD, AND PROJECTOR

BACKGROUND

1. Technical Field

The present invention relates to a discharge lamp lighting device, a discharge lamp lighting method, and a projector.

2. Related Art

Traditionally, as a light source for projector, for example, a discharge lamp such as an ultrahigh pressure mercury lamp, metal halide lamp or xenon lamp is used.

By the way, in a discharge lamp lighting device that controls lighting of such a discharge lamp, overshoot and undershoot may occur in the waveform of a drive current that is applied when the discharge lamp is lit.

Overshoot and undershoot are a phenomenon in which a higher current than expected flows temporarily between the electrodes of the discharge lamp, due to causes such as the circuit configuration of the discharge lamp lighting device, and in which every time the polarity of the drive current supplied to the discharge lamp is switched, the waveform of the drive current exceeds a base line that provides a stationary value, at rising and falling edges of the waveform (rectangular wave) of the drive current.

The occurrence of overshoot and undershoot causes change in illuminance of the discharge lamp and damage to the electrodes of the discharge lamp or the like. Specifically, overheating of the electrodes of the discharge lamp due to the occurrence of overshoot and undershoot causes evaporation of tungsten forming the electrodes and may cause blacking of the discharge lamp. Also, if vibration due to the occurrence of overshoot and undershoot is transmitted to the electrodes of the discharge lamp, it may cause breakdown of electrode coils.

Such damage due to the occurrence of overshoot and undershoot happens a greater number of times as the drive frequency of the discharge lamp becomes higher, and the damage is greater as the drive power (current, voltage) supplied to the discharge lamp is higher. Therefore, in the discharge lamp lighting device, the occurrence of overshoot and undershoot needs to be restrained as much as possible.

As a method for restraining the occurrence of overshoot (undershoot), for example, a method in which the current value is corrected and controlled with plural timers so as to reduce overshoot is proposed (see JP-A-9-232091). Also, a method in which an overshoot deterrent circuit is provided and made to operate every time the voltage, current, power and amount of light of the discharge lamp reach a predetermined value is proposed (see JP-A-2004-39397).

However, each of such traditional overshoot restraining methods lowers the responsiveness of the control unit to the drive waveform. If the occurrence of overshoot is restrained excessively, the waveform of the drive current and the drive power or the like cannot be controlled accurately.

In such a case, a projected image from a projector may flicker because of change in illuminance of the discharge lamp. Particularly, this phenomenon depends on the drive frequency of the discharge lamp and becomes more difficult to control as the frequency becomes higher.

SUMMARY

An advantage of some aspects of the invention is that a discharge lamp lighting device and a discharge lamp lighting method in which lighting control of a discharge lamp can be properly carried out while the influence of the occurrence of overshoot and undershoot is restrained and a projector having such a discharge lamp lighting device are provided.

An aspect of the invention is directed to a discharge lamp lighting device for controlling lighting of a discharge lamp including a drive unit that drives the discharge lamp, and a control unit that controls the drive unit. The control unit varies a current value of overshoot and undershoot generated in a waveform of a drive current that is applied when the drive unit drives the discharge lamp, at least according to a magnitude of drive power supplied to the discharge lamp.

In this discharge lamp lighting device, the current value of overshoot and undershoot generated in the waveform of the drive current that is applied when the drive unit drives the discharge lamp is varied according to the magnitude of the drive power supplied to the discharge lamp. Thus, lighting control of the discharge lamp can be properly carried out while the influence of the occurrence of overshoot and undershoot is restrained.

It is preferable that the control unit causes the current value of overshoot and undershoot to be relatively small when the drive power supplied to the discharge lamp is large, and causes the current value of overshoot and undershoot to be relatively large when the drive power supplied to the discharge lamp is small.

In this case, since the current value of overshoot and undershoot is made relatively small when the drive power supplied to the discharge lamp is large, the influence of the occurrence of overshoot and undershoot can be restrained to a low level while a fall in the response speed of the control unit is allowed to a certain extent. Meanwhile, since the current value of overshoot and undershoot is made relatively large when the drive power supplied to the discharge lamp is small, lighting control of the discharge lamp can be properly carried out while the response speed of the control unit is raised.

It is also preferable that the control unit varies the current value of overshoot and undershoot generated in the waveform of the drive current that is applied when the drive unit drives the discharge lamp, according to a drive mode of the discharge lamp.

In this case, since the current value of overshoot and undershoot generated in the waveform of the drive current that is applied when driving the discharge lamp is varied according to the drive mode of the discharge lamp, lighting control of the discharge lamp can be properly carried out while the influence of the occurrence of overshoot and undershoot is restrained.

It is also preferable that the control unit causes the current value of overshoot and undershoot to be relatively small when an average drive frequency of the discharge lamp is high, and causes the current value of overshoot and undershoot to be relatively large when the average drive frequency of the discharge lamp is low, according to the drive mode of the discharge lamp.

In this case, since the current value of overshoot and undershoot is made relatively small when the average drive frequency of the discharge lamp is high, the influence of the occurrence of overshoot and undershoot can be restrained to a low level. Meanwhile, since the current value of overshoot and undershoot is made relatively large when the average drive frequency of the discharge lamp is low, lighting control of the discharge lamp can be properly carried out.

It is also preferable that the control unit causes the current value of overshoot and undershoot to be relatively large when a range of fluctuation in drive frequency of the discharge lamp is large, according to the drive mode of the discharge lamp.

In this case, since the current value of overshoot and undershoot is made relatively large when the range of fluctuation in the drive frequency of the discharge lamp is large, lighting control of the discharge lamp can be properly carried out.

It is also preferable that the control unit uses a current value obtained by multiplying the current value of overshoot and undershoot corresponding to the magnitude of the drive power supplied to the discharge lamp by a coefficient corresponding to the drive mode of the discharge lamp.

In this case, while both adjustment of the current value of overshoot and undershoot corresponding to the magnitude of the drive power supplied to the discharge lamp and adjustment of the current value of overshoot and undershoot corresponding to the drive mode of the discharge lamp can be achieved, the influence of the occurrence of overshoot and undershoot can be restrained and lighting control of the discharge lamp can be properly carried out.

Also, the drive unit may have a step-down chopper unit that lowers inputted DC power to a predetermined output voltage and outputs the resulting DC power, and a power conversion unit that converts the DC power supplied from the step-down chopper unit to AC power and outputs the resulting AC power. The step-down chopper unit may output, based on a control signal from the control unit, DC power that is converted to an output voltage corresponding to a duty ratio of the control signal. The control unit may change the duty ratio of the control signal during a predetermined period and thus vary the current value of overshoot and undershoot.

In this case, the current value of overshoot and undershoot can be varied according to the magnitude of the drive power supplied to the discharge lamp and the drive mode of the discharge lamp.

Another aspect of the invention is directed to a discharge lamp lighting method for controlling lighting of a discharge lamp including, at least according to a magnitude of drive power supplied to the discharge lamp, varying a current value of overshoot and undershoot generated in a waveform of a drive current thereof.

In this discharge lamp lighting method, since the current value of overshoot and undershoot generated in the waveform of the drive current that is applied when driving the discharge lamp is varied according to the magnitude of the drive power supplied to the discharge lamp, lighting control of the discharge lamp can be properly carried out while the influence of the occurrence of overshoot and undershoot is restrained.

It is preferable that the current value of overshoot and undershoot is made relatively small when the drive power supplied to the discharge lamp is large, whereas the current value of overshoot and undershoot is made relatively large when the drive power supplied to the discharge lamp is small.

In this case, since the current value of overshoot and undershoot is made relatively small when the drive power supplied to the discharge lamp is large, the influence of the occurrence of overshoot and undershoot can be restrained to a low level while a fall in the response speed of the control unit is allowed to a certain extent. Meanwhile, since the current value of overshoot and undershoot is made relatively large when the drive power supplied to the discharge lamp is small, lighting control of the discharge lamp can be properly carried out while the response speed of the control unit is raised.

It is also preferable that, according to a drive mode of the discharge lamp, the current value of overshoot and undershoot generated in a waveform of a drive current thereof is varied.

In this case, since the current value of overshoot and undershoot generated in the waveform of the drive current that is applied when driving the discharge lamp is varied according to the drive mode of the discharge lamp, lighting control of the discharge lamp can be properly carried out while the influence of the occurrence of overshoot and undershoot is restrained.

It is also preferable that, according to the drive mode of the discharge lamp, the current value of overshoot and undershoot is made relatively small when an average drive frequency of the discharge lamp is high, whereas the current value of overshoot and undershoot is made relatively large when the average drive frequency of the discharge lamp is low.

In this case, since the current value of overshoot and undershoot is made relatively small when the average drive frequency of the discharge lamp is high, the influence of the occurrence of overshoot and undershoot can be restrained to a low level. Meanwhile, since the current value of overshoot and undershoot is made relatively large when the average drive frequency of the discharge lamp is low, lighting control of the discharge lamp can be properly carried out.

It is also preferable that, according to the drive mode of the discharge lamp, the current value of overshoot and undershoot is made relatively large when a range of fluctuation in drive frequency of the discharge lamp is large.

In this case, since the current value of overshoot and undershoot is made relatively large when the range of fluctuation in the drive frequency of the discharge lamp is large, lighting control of the discharge lamp can be properly carried out.

It is also preferable that a current value obtained by multiplying the current value of overshoot and undershoot corresponding to the magnitude of the drive power supplied to the discharge lamp by a coefficient corresponding to the drive mode of the discharge lamp is used.

In this case, while both adjustment of the current value of overshoot and undershoot corresponding to the magnitude of the drive power supplied to the discharge lamp and adjustment of the current value of overshoot and undershoot corresponding to the drive mode of the discharge lamp can be achieved, the influence of the occurrence of overshoot and undershoot can be restrained and lighting control of the discharge lamp can be properly carried out.

Still another aspect of the invention is directed to a projector including the discharge lamp lighting device of any of the configurations described above.

This projector has a discharge lamp lighting device in which lighting control of the discharge lamp can be properly carried out while the influence of the occurrence of overshoot and undershoot is restrained. Therefore, further improvement in quality can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail with reference to the drawings.

The drawings described below may show an enlarged view of a characteristic portion in order to facilitate understanding. Dimensional proportions of individual components may not be the same as the actual dimensional proportions thereof.

Projector

Figure 1:
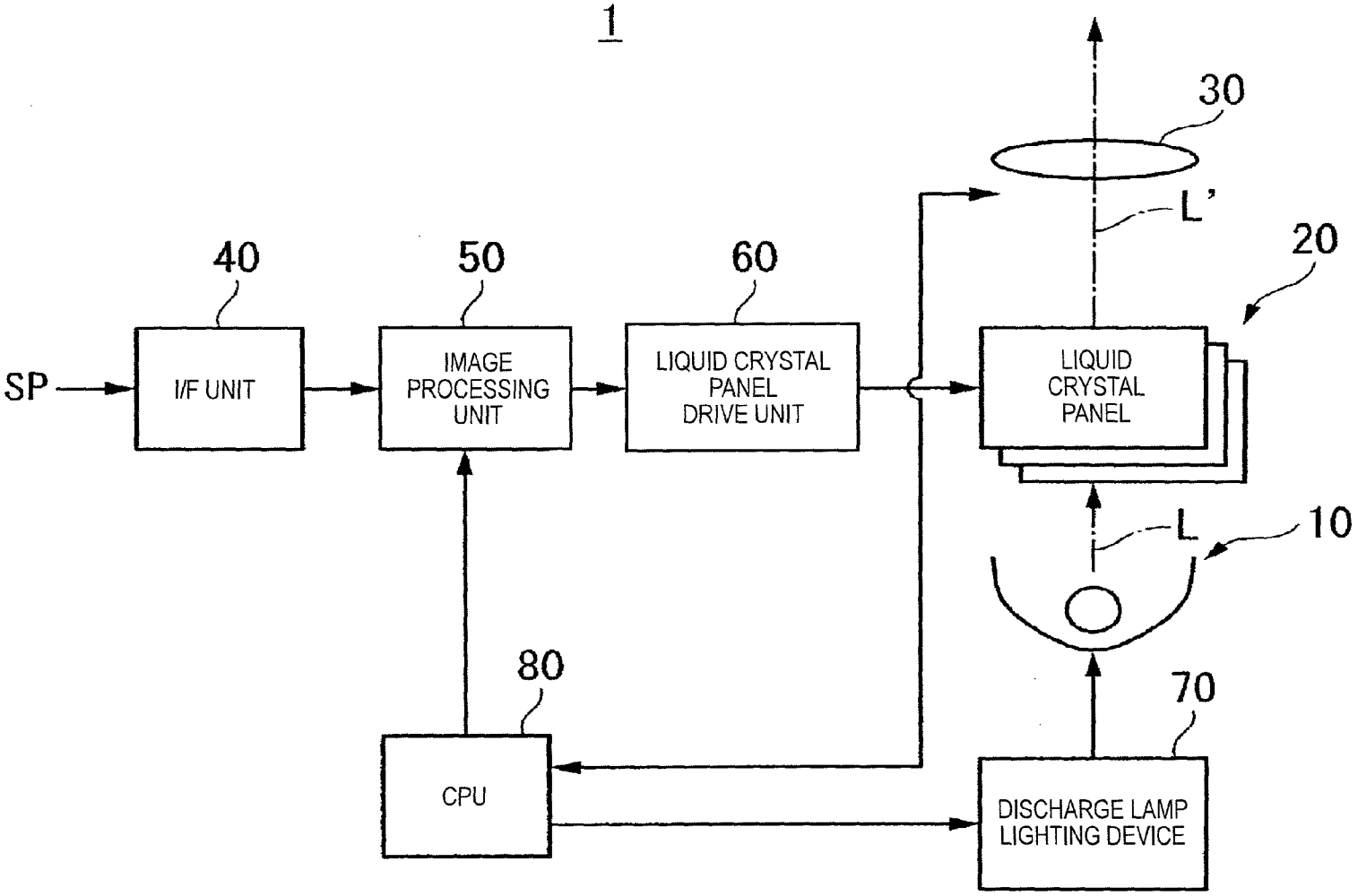
FIG. 1 is a block diagram showing a configuration example of a projector according to an embodiment.

FIG. 1 is a block diagram showing a configuration example of a projector 1 according to this embodiment.

As shown in FIG. 1, this projector 1 schematically includes a discharge lamp (light source) 10 that casts illumination light L, a liquid crystal panel (light modulator) 20 that modulates the illumination light L according to image data and thus forms image light L', and a projection system 30 that projects the image light L' onto a screen (not shown).

In this embodiment, the case where an ultrahigh pressure mercury lamp utilizing arc discharge is used as the discharge lamp 10 is illustrated. However, the discharge lamp is not limited to this example. For example, any discharge lamp such as a metal halide lamp or xenon lamp can be used.

Also, the projector 1 schematically includes an interface (I/F) unit 40, an image processing unit 50, a liquid crystal panel drive unit 60, a discharge lamp lighting device 70, and a CPU (central processing unit) 80.

The interface unit 40 is configured to convert an image signal inputted from a personal computer or the like, not shown, into image data in a format that can be processed by the image processing unit 50.

The image processing unit 50 is configured to perform various kinds of image processing such as luminance adjustment and color balance adjustment on the image data supplied from the interface unit 40.

The liquid crystal panel drive unit 60 is configured to drive the liquid crystal panel 20 based on the image data on which image processing is performed by the image processing unit 50.

The discharge lamp lighting device 70 is configured to control lighting of the discharge lamp 10. The discharge lamp lighting device 70 applies a high-frequency voltage of approximately several dozens of kHz between a pair of electrodes of the discharge lamp 10, using a resonance circuit unit 73, later described, when starting the discharge lamp 10. After the start, the discharge lamp lighting device 70 performs an operation to lower the drive frequency of the discharge lamp 10 to a stationary frequency (approximately several hundreds of Hz) that is lower than the resonance frequency, and carries out stationary lighting at this stationary frequency.

The CPU 80 is configured to control the image processing unit 50 and the projection system 30 according to an operation of an operation button provided on a remote controller, not shown, or on a main body of the projector 1 or the like.

In this embodiment, for example, when the user operates a power switch (not shown) of the projector 1, the CPU 80 outputs a control signal to light the discharge lamp 10, to the discharge lamp lighting device 70.

Discharge Lamp Lighting Device

Figure 2:
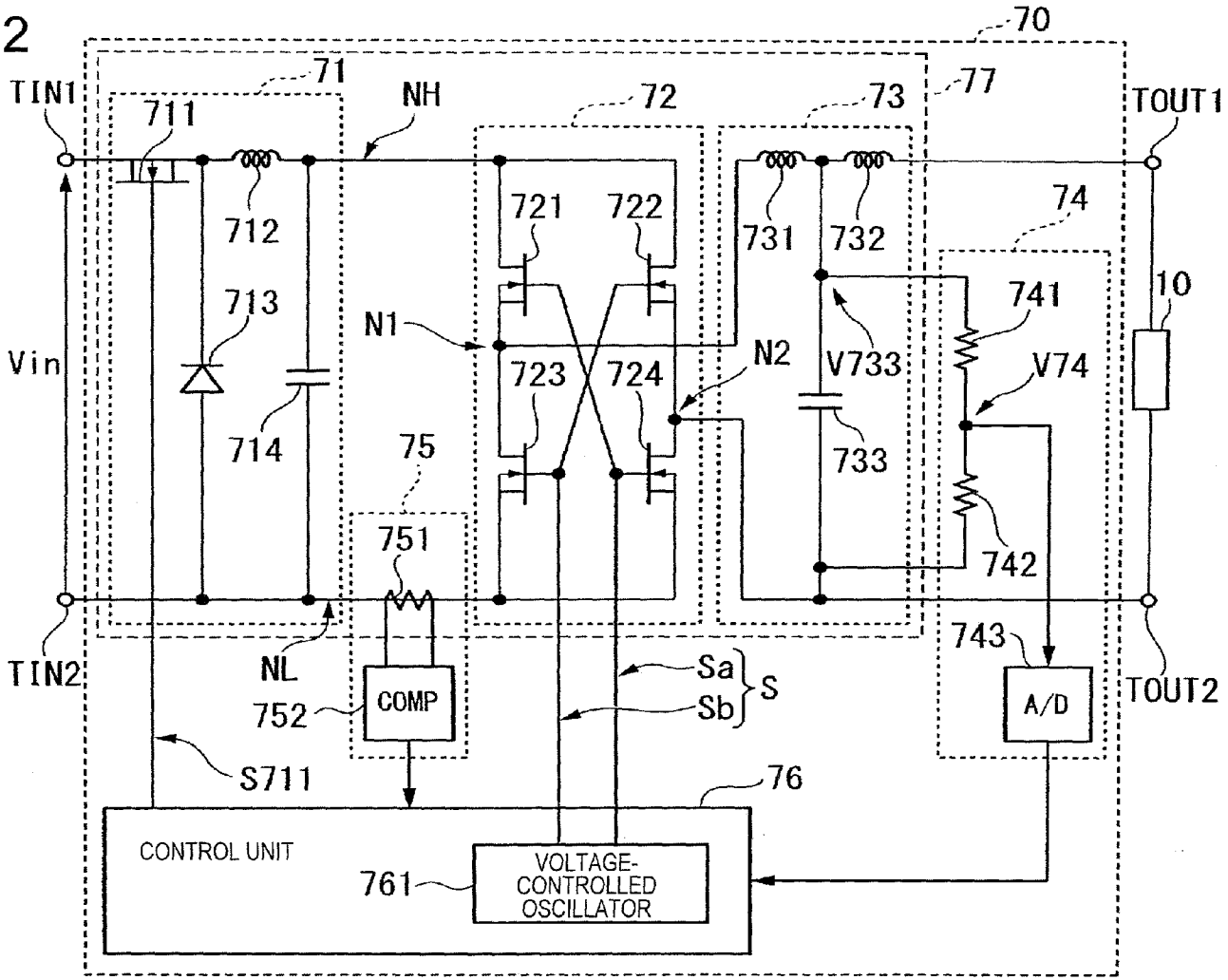
FIG. 2 is a block diagram showing a configuration example of a discharge lamp lighting device according to an embodiment.

FIG. 2 is a block diagram showing a configuration example of the discharge lamp lighting device 70 according to this embodiment.

The discharge lamp lighting device 70 schematically includes a step-down chopper unit 71, a power conversion unit 72, a resonance circuit unit 73, a voltage detection unit 74, a lighting detection unit 75, and a control unit 76, as shown in FIG. 2. Of these units, the step-down chopper unit 71, the power conversion unit 72 and the resonance circuit unit 73 form a drive unit 77 that drives the discharge lamp 10.

The step-down chopper unit 71 is configured to convert DC power having a voltage Vin applied between an input terminal TIN1 and an input terminal TIN2 from a DC power source, not shown, to DC power having a predetermined DC voltage. The step-down chopper unit 71 includes, for example, an n-channel field effect transistor (FET) 711, a choke coil 712, a diode 713, and a capacitor 714.

In this step-down chopper unit 71, a current flowing through the FET 711 is chopped, based on a control signal S711 supplied from the control unit 76. Thus, DC power having a desired output voltage corresponding to the duty ratio of the control signal S711 can be provided.

The power conversion unit 72 is configured to convert the DC power supplied from the step-down chopper unit 71 to AC power and supply the AC power to the discharge lamp 10 via the resonance circuit unit 73. The power conversion unit 72 includes, for example, a full-bridge circuit made up of four n-channel field effect transistors (FETs) 721 to 724.

That is, of the FETs 721 to 724 forming the full-bridge circuit, the drains of the FETs 721, 722 are connected to a high-potential node NH connecting to the input terminal TIN1 via the FET 711 and the choke coil 712 forming the step-down chopper unit 71. The sources of the FETs 721, 722 are connected to the drains of the FETs 723, 724, respectively. The sources of the FETs 723, 724 are connected to a low-potential node NL connecting to the input terminal TIN2 via a resistor 751 forming the lighting detection unit 75, later described.

The gates of the FET 721 and the FET 724 are supplied with a control signal Sa from the control unit 76. The gates of the FET 722 and FET 723 are supplied with a control signal Sb equivalent to an inverse signal of the control signal Sa, from the control unit 76.

In this embodiment, a connection part between the source of the FET 721 and the drain of the FET 723 is defined as one output node N1 of the power conversion unit 72. A connection part between the source of the FET 722 and the drain of the FET 724 is defined as the other output node N2 of the power conversion unit 72.

The power conversion unit 72 can convert DC power to AC power by switching the pair of FETs 722, 723 and the pair of FETs 721, 724 in a complementary manner, based on the control signals S (Sa, Sb) supplied from the control unit 76.

While the power conversion unit 72 is made up of a full-bridge circuit in this embodiment, any circuit format such as a half-bridge circuit may be used as a circuit form of the power conversion unit 72 as long as AC power can be supplied to the resonance circuit unit 73.

The resonance circuit unit 73 functions as an igniter that generates a high voltage that exceeds a discharge start voltage (breakdown voltage) of the discharge lamp 10. The resonance circuit unit 73 is connected to the discharge lamp 10 in parallel to the power conversion unit 72 via output terminals TOUT1, TOUT2.

The resonance circuit unit 73 includes two coils 731, 732 that are magnetically coupled, and a capacitor 733. Of these components, one end of the coil 731 is connected to the output node N1 of the power conversion unit 72. The other end of the coil 731 is connected to one end of the coil 732. The other end of the coil 732 is connected to the output terminal TOUT1. Meanwhile, one electrode of the capacitor 733 is connected to a connection node between the coil 731 and the coil 732. The other electrode of the capacitor 733 is connected to the output node N2 of the power conversion unit 72 and also connected to the output terminal TOUT2.

In this embodiment, the coil 731 and the capacitor 733 constituting the resonance circuit unit 73 form an LC series resonance circuit. Basically, a resonance frequency of this LC series resonance circuit (a resonance frequency defined by the coil 731 and the capacitor 733) serves as a resonance frequency specific to the resonance circuit unit 73. Therefore, if the frequency of AC power supplied from the power conversion unit 72 coincides with the resonance frequency of the resonance circuit unit 73, and the LC series resonance circuit made up of the coil 731 and the capacitor 733 enters a resonating state, an inter-terminal voltage V733 of the capacitor 733 becomes infinite in principle and a high voltage that is necessary to start discharge of the discharge lamp 10 can be provided from the resonance circuit unit 73.

Here, even when the LC series resonance circuit is in a resonating state, if there is a resistance component or wiring impedance of the FETs 721 to 724 forming the power conversion unit 72, the inter-terminal voltage V733 of the capacitor 733 remains approximately at 1 to 1.5 kV and a high voltage that is necessary to start discharge of the discharge lamp 10 cannot be obtained.

Thus, in this embodiment, the coil 732 magnetically coupled with the coil 731 forming the LC series resonance circuit is arranged and the inter-terminal voltage V733 of the capacitor 733 is amplified according to the turn ratio between the coil 731 and the coil 732. Thus, a high voltage (resonance voltage) of several kV that is necessary to start discharge of the discharge lamp 10 is ultimately generated.

The voltage detection unit 74 is configured to detect the inter-terminal voltage V733 of the capacitor 733 forming the resonance circuit unit 73. The voltage detection unit 74 includes a resistor 741 and a resistor 742 that are connected in series between the terminals of the capacitor 733, and an analog/digital (A/D) conversion unit 743.

Of these components, the resistor 741 and the resistor 742 are configured to divide the inter-terminal voltage V733 of the capacitor 733 of the resonance circuit unit 73 and obtain a voltage V74 corresponding to the resistance ratio thereof.

Meanwhile, the analog/digital conversion unit 743 is configured to convert the divided voltage V74 to digital data and output the digital data. In this embodiment, the divided voltage V74 is a voltage of an intermediate stage generated to adapt the voltage V733 to input characteristics of the analog/digital conversion unit 743. Therefore, the digital data outputted from the analog/digital conversion unit 743 represents the value of the voltage V733. The voltage V733 detected by the voltage detection unit 74 is supplied to the control unit 76.

The lighting detection unit 75 is configured to detect lighting/non-lighting of the discharge lamp 10. The lighting detection unit 75 includes a resistor 751 and a comparator unit 752.

Of these components, the resistor 751 is connected between the input terminal TIN2 and the sources of the FETs 723, 724 forming the power conversion unit 72. An inter-terminal voltage (drop voltage) of the resistor 751 is inputted to the comparator unit 752.

The comparator unit 752 detects a current flowing through the discharge lamp 10, based on the inter-terminal voltage of the resistor 751, and compares the detected current with a predetermined voltage value (not shown) corresponding to a current flowing through the resistor 751 when the discharge lamp 10 is lit. The comparator unit 752 thus detects lighting/non-lighting of the discharge lamp 10.

That is, for example, if the inter-terminal voltage of the resistor 751 is equal to or higher than a predetermined voltage value, the lighting detection unit 75 detects lighting of the discharge lamp 10. Meanwhile, if the inter-terminal voltage of the resistor 751 is below the predetermined voltage value, the lighting detection unit 75 detects non-lighting of the discharge lamp 10. When lighting of the discharge lamp is detected, the lighting detection unit 75 outputs a signal to that effect to the control unit 76.

The control unit 76 is configured to control the switching of each of the step-down chopper unit 71 and the power conversion unit 72. The control unit 76 also has a voltage-controlled oscillator 761. The voltage-controlled oscillator 761 is configured to output a signal with a frequency corresponding to an input voltage (not shown), as a control signal S. A signal prescribing the input voltage of the voltage-controlled oscillator 761 is generated in the control unit 76 in such a way that the switching of the power conversion unit 72 can be provided.

Discharge Lamp Lighting Method

Next, lighting control of the discharge lamp lighting device 70 (discharge lamp lighting method) according to this embodiment will be described.

Figure 3:
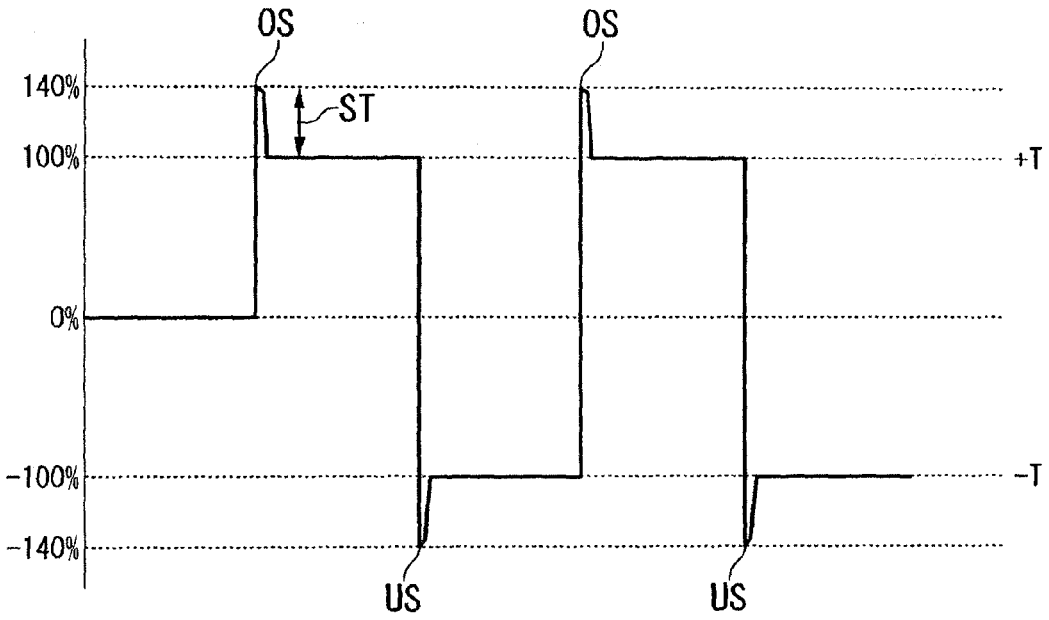
FIG. 3 shows an example of the waveform of drive current in the case where overshoot and undershoot occur.

In the discharge lamp lighting device 70, overshoot OS and undershoot US may occur in the waveform (rectangular wave) of a drive current that is applied when lighting the discharge lamp 10, for example, as shown in FIG. 3. FIG. 3 illustrates the waveform of a drive current in which overshoot OS and undershoot US occur.

In the lighting control according to the invention, the current value of overshoot OS and undershoot US generated in the waveform of the drive current that is applied when driving the discharge lamp 10 is varied according to the magnitude of drive power supplied to the discharge lamp 10.

Specifically, the control unit 76 can vary the amount of generation (current value) ST of overshoot OS and undershoot US by changing the duty ratio of the control signal S711 during a predetermined period.

That is, the step-down chopper unit 71 outputs DC power to the FETs 721 to 724 forming the full-bridge circuit of the power conversion unit 72, by switching ON/OFF the FET 711 as a switching element.

The power conversion unit 72 converts the DC power supplied from the step-down chopper unit 71 to AC power. In the power conversion unit 72, when the waveform of the drive current becomes inverted in polarity, there is a moment when all the FETs 721, to 724 forming the full-bridge circuit become OFF, thus interrupting electrification.

At this point, if the FET 711 is turned ON, electric charge is stored in the capacitor 714. When the full-bridge circuit is electrified again, the electric charge stored in the capacitor 714 is discharged. The waveform of the drive current at this point appears in the form of overshoot OS or undershoot US.

In the waveform (rectangular wave) of the drive current shown in FIG. 3, overshoot OS and undershoot US, in which the waveform exceeds base lines ±T that provides a stationary value, occur at a rising edge and a falling edge of the waveform of the drive current every time the polarity of the drive current is switched.

Therefore, as the step-down chopper unit 71 changes the ON/OFF duty ratio of the FET 711, the amount of electric charge stored in the capacitor 714 is adjusted. Thus, the amount of generation (current value) ST of overshoot OS and undershoot US can be adjusted.

That is, if the ON duty ratio of the step-down chopper unit 71 is increased to raise the voltage from the step-down chopper unit 71, the amount of electric charge stored in the capacitor 714 increases and the amount of generation (current value) ST of overshoot OS and undershoot US becomes relatively large. Meanwhile, if the ON duty ratio of the step-down chopper unit 71 is decreased to lower the voltage from the step-down chopper unit 71, the amount of electric charge stored in the capacitor 714 decreases and the amount of generation (current value) ST of overshoot OS and undershoot US becomes relatively small.

Here, with respect to the amount of generation (current value) ST of overshoot OS and undershoot US, the value in terms of percentage expressing a proportion in which the waveform of the drive current applied when driving the discharge lamp 10 exceeds the base line T that provides a stationary value, is defined as an "overshoot rate". For example, when the rated power ratio (%) is 100%, the overshoot rate in the waveform shown in FIG. 3 is (140−100)/100×100=40%. In this case, since the occurrence of overshoot OS and the occurrence of undershoot US show the same value, these are collectively expressed as an "overshoot rate".

The rated power ratio is the power value at the time of driving the discharge lamp 10 divided by the rated value of drive power, expressed in terms of percentage (%). For example, if the rated value of drive power of the discharge lamp 10 is 280 W, the rated power ratio at the time of driving the discharge lamp 10 with 280 W is 280/280×100=100%.

In the lighting control according to the invention, the current value of overshoot OS and undershoot US is adjusted in such a way that the current value becomes relatively small when the drive power supplied to the discharge lamp 10 is large, whereas the current value of overshoot OS and undershoot US is adjusted in such a way that the current value becomes relatively large when the drive power supplied to the discharge lamp 10 is small.

For example, Table 1 illustrates the rated power ratio (%) and the overshoot rate (%) for each drive power in the case where the rated value of drive power of the discharge lamp 10 is 280 W.

TABLE 1

| Drive Power [W] | Rated power ratio [%] | Overshoot rate [%] |
|---|---|---|
| 280 | 100 | 10 (Z < 15) |
| 250 | 90 | 15 (Z < 20) |
| 200 | 70 | 20 (Z < 29) |
| 170 | 60 | 30 (Z < 33) |

In the lighting control according to the invention, the current value of overshoot OS and undershoot US in the waveform of the drive current that is applied when driving the discharge lamp 10 is varied every drive power of the discharge lamp 10, as shown in Table 1.

Here, with respect to the current value of overshoot OS and undershoot US, it is preferable that the overshoot rate of the drive current supplied to the discharge lamp 10 is set every drive power to the discharge lamp 10 in such a way as to satisfy the following equation (1), which is experimentally calculated.

$$Z<-0.45\ W+60 \quad (1)$$

Z: overshoot rate [%]

W: rated power ratio [%]

That is, it is preferable that the overshoot rate of the drive current is set at a relatively small value, based on the equation (1), when the drive power supplied to the discharge lamp 10 is large, whereas the overshoot rate of the drive current is set at a relatively large value, based on the equation (1), when the drive power supplied to the discharge lamp 10 is small.

Figure 4:
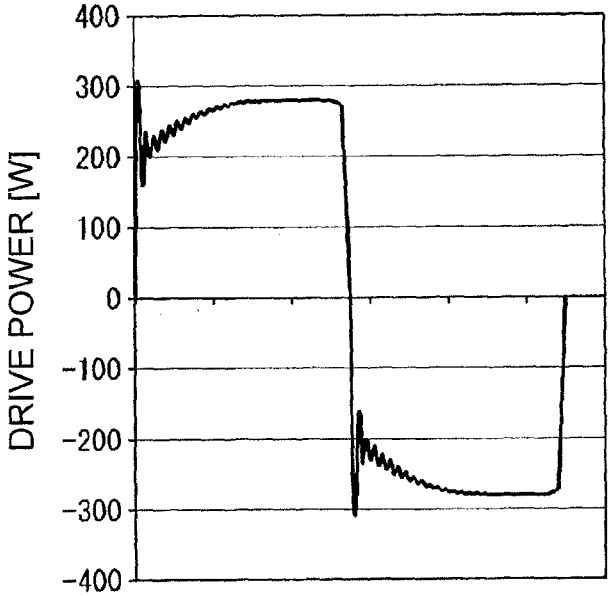
FIG. 4 shows the waveform of drive current in the case where the overshoot rate is set at 10% when the drive power is 280 W, as shown in Table 1.
Figure 5:
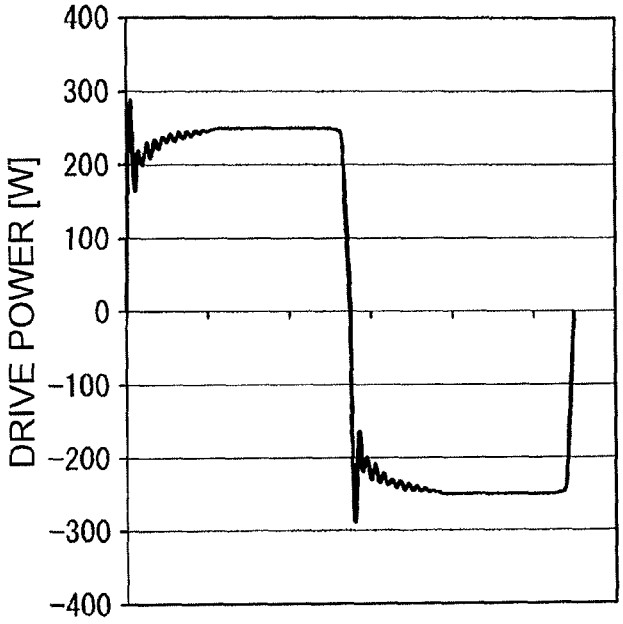
FIG. 5 shows the waveform of drive current in the case where the overshoot rate is set at 15% when the drive power is 250 W, as shown in Table 1.
Figure 6:
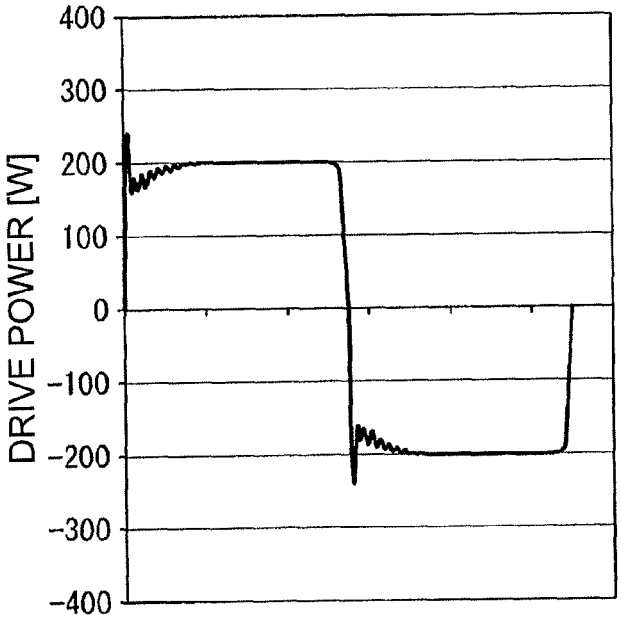
FIG. 6 shows the waveform of drive current in the case where the overshoot rate is set at 20% when the drive power is 200 W, as shown in Table 1.
Figure 7:
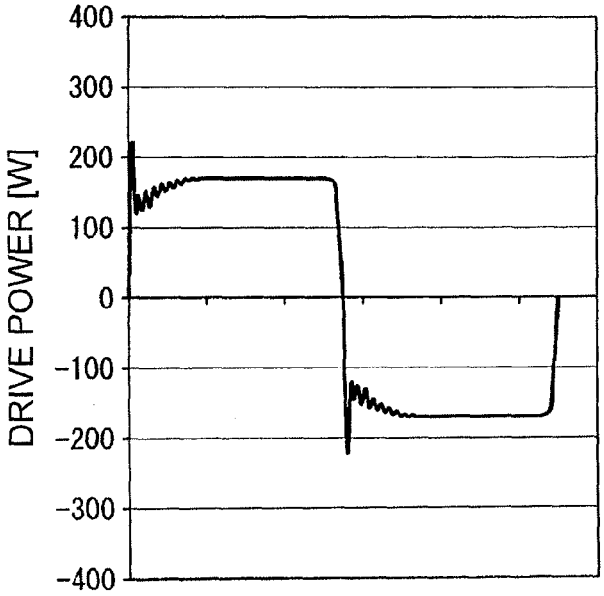
FIG. 7 shows the waveform of drive current in the case where the overshoot rate is set at 30% when the drive power is 170 W, as shown in Table 1.

FIGS. 4 to 7 show the waveforms of the drive current supplied to the discharge lamp 10 for each drive power of the discharge lamp 10 shown in Table 1. FIG. 4 shows the waveform of the drive current in the case where the overshoot rate is set at 10% when the drive power is 280 W (rated power ratio 100%) as shown in Table 1. FIG. 5 shows the waveform of the drive current in the case where the overshoot rate is set at 15% when the drive power is 250 W (rated power ratio 90%) as shown in Table 1. FIG. 6 shows the waveform of the drive current in the case where the overshoot rate is set at 20% when the drive power is 200 W (rated power ratio 70%) as shown in Table 1. FIG. 7 shows the waveform of the drive current in the case where the overshoot rate is set at 30% when the drive power is 170 W (rated power ratio 60%) as shown in Table 1.

Based on the equation (1), it is preferable that an upper limit of the overshoot rate Z is set not to exceed the value of "−0.45 W+60". Meanwhile, it is preferable that a lower limit of the overshoot rate Z is set within a range that enables accurate control of the waveform of the drive current, the drive power and the like, and that does not cause any flickering in a projected image from the projector 1 due to change in illuminance of the discharge lamp 10.

In the discharge lamp lighting device 70, control is performed to lower the current value of overshoot OS and undershoot US as the drive power of the discharge lamp 10 increases, as shown in FIGS. 4 to 7. On the contrary, in the discharge lamp lighting device 70, control is performed to raise the current value of overshoot OS and undershoot US as the drive power of the discharge lamp 10 decreases.

When the drive power of the discharge lamp 10 is high, the electrodes of the discharge lamp 10 provide stable discharge because of protrusion melting with high temperature, and flickering is less likely to happen. Therefore, in order to restrain the risk of damage to the discharge lamp 10 while allowing a fall in response speed of the control unit 76 to a certain extent, control is performed to lower the current value of overshoot OS and undershoot US. Thus, the current value of overshoot OS and undershoot US is made relatively small, and the influence of the occurrence of overshoot OS and undershoot US can be restrained to a low level.

On the other hand, when the drive power of the discharge lamp 10 is low, the electrodes of the discharge lamp 10 are less likely to melt, thus increasing the risk of flickering. Meanwhile, since the drive power of the discharge lamp 10 is low, the risk of damage to the discharge lamp 10 is lower than in high-power driving. Thus, in order to enable accurate control of the waveform of the drive current while raising the response speed of the control unit 76 without excessively restraining the current value of overshoot OS and undershoot US, control is performed to raise the current value of overshoot OS and undershoot US. Therefore, the current value of overshoot OS and undershoot US is made relatively large, and lighting control of the discharge lamp 10 can be properly carried out.

Also, in the lighting control according to the invention, the current value of overshoot OS and undershoot US generated in the waveform of the drive current is varied according to the drive mode of the discharge lamp 10.

Specifically, in the lighting control according to the invention, the current value of overshoot OS and undershoot US is adjusted in such a way that the current value becomes relatively small when the average drive frequency of the discharge lamp 10 is high, whereas the current value of overshoot OS and undershoot US is adjusted in such a way that the current value becomes relatively large when the average drive frequency of the discharge lamp 10 is low, according to the drive mode of the discharge lamp 10.

If the drive power of the discharge lamp 10 is the same and the drive mode of the discharge lamp is different, the risk that overshoot OS and undershoot US occur increases in a drive mode where the average drive frequency of the discharge lamp is higher.

Thus, a coefficient (hereinafter referred to as an overshoot coefficient) by which the current value of overshoot OS and undershoot US set for each drive power of the discharge lamp 10 is multiplied is decided according to the difference in the average drive frequency.

For example, Table 2 illustrates overshoot coefficients in the case where the average drive frequency is high (drive mode A) and the case where the average drive frequency is low (drive mode B), of the drive modes of the discharge lamp 10.

TABLE 2

| Drive Mode | Overshoot Coefficient |
|---|---|
| A (average drive frequency high) | 0.8 |
| B (average drive frequency low) | 1.2 |

In the discharge lamp lighting device 70, control is performed to lower the current value of overshoot OS and undershoot US as the average drive frequency of the discharge lamp 10 becomes higher. Conversely, control is performed to raise the current value of overshoot OS and undershoot US as the average drive frequency of the discharge lamp 10 becomes lower.

In this way, in the drive mode where the average drive frequency of the discharge lamp 10 is high, quick response is demanded of the control unit 76. However, it is preferable that the current value of overshoot OS and undershoot US is set in consideration of the risk to the discharge lamp 10.

Thus, lighting control of the discharge lamp 10 can be properly carried out while the influence of the occurrence of overshoot OS and undershoot US is restrained to a low level.

Also, in the lighting control according to the invention, the current value of overshoot OS and undershoot US is adjusted in such a way that the current value becomes relatively large when the range of fluctuation in the drive frequency of the discharge lamp 10 is large, according to the drive mode of the discharge lamp 10.

Figure 8:
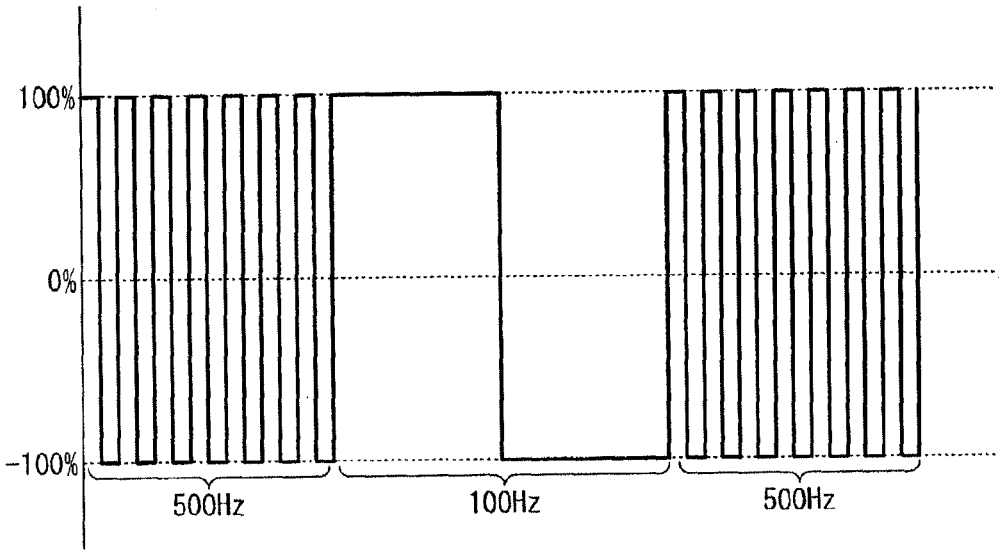
FIG. 8 shows an example of the waveform of drive current in the case where drive frequency changes.

Specifically, in the discharge lamp lighting device 70, the drive frequency may suddenly change depending on the drive mode at the time of lighting the discharge lamp 10, for example, as shown in FIG. 8. FIG. 8 illustrates the waveform of the drive current where the drive frequency of the discharge lamp 10 changes.

In the waveform of the drive current shown in FIG. 8, the range of fluctuation in the drive frequency is larger in a section where the drive frequency is switched from 500 Hz to 100 Hz and in a section where the drive frequency is switched from 100 Hz to 500 Hz. In these sections, if the current value of overshoot OS and undershoot US is restrained excessively, the responsiveness of the control unit 76 falls and the waveform of the drive current cannot be outputted accurately.

Thus, an overshoot coefficient by which the current value of overshoot OS and undershoot US set for each drive power of the discharge lamp 10 is multiplied is decided according to the difference in the range of fluctuation in the drive frequency.

For example, Table 3 illustrates overshoot coefficients in the case where the range of fluctuation in the drive frequency is large (drive mode C) and the case where the range of fluctuation in the drive frequency is small (drive mode D), of the drive modes of the discharge lamp 10.

TABLE 3

| Drive mode | Overshoot Coefficient |
|---|---|
| C (drive frequency fluctuation range large) | 1.2 |
| D (drive frequency fluctuation range small) | 1 |

In the discharge lamp lighting device 70, control is performed to relatively increase the current value of overshoot OS and undershoot US as the range of fluctuation in the drive frequency of the discharge lamp 10 becomes larger. Thus, the waveform of the drive current, the drive power and the like can be accurately controlled and can also be set within a range where no flickering is generated in a projected image from the projector 1 due to change in illuminance of the discharge lamp 10.

Table 4 summarizes the overshoot rate Z found from the magnitude of the drive power supplied to the discharge lamp 10 and the overshoot coefficient that is set according to the drive mode of the discharge lamp 10.

TABLE 4

| | | Drive Mode | | | | |
|---|---|---|---|---|---|---|
| | | Average Drive Freq. High (0.8) — | Average Drive Freq. Mid (1.0) — | Average Drive Freq. Low (1.2) — | Average Drive Freq. High (0.8) Fluctuation Range Large (1.2) | Average Drive Freq. Mid (1.0) Fluctuation Range Large (1.2) |
| Drive Power | 280 W | 8 | 10 | 12 | 9.6 | 12 |
| | 250 W | 12 | 15 | 18 | 14.4 | 18 |
| | 200 W | 16 | 20 | 24 | 19.2 | 24 |
| | 170 W | 24 | 30 | 36 | 28.8 | 36 |

In the lighting control according to the invention, control is performed to provide a current value obtained by multiplying the current value of overshoot OS and undershoot US corresponding to the magnitude of the drive power supplied to the discharge lamp 10 by the overshoot coefficient corresponding to the drive mode of the discharge lamp 10.

That is, in the lighting control according to the invention, the current value that is set for each drive power of the discharge lamp 10 is multiplied by the overshoot coefficient that is set for each drive mode, thus setting the current value of overshoot OS and undershoot US corresponding to the drive power and the drive mode of the discharge lamp 10.

Thus, while both adjustment of the current value of overshoot OS and undershoot US corresponding to the magnitude of the drive power supplied to the discharge lamp 10 and adjustment of the current value of overshoot OS and undershoot US corresponding to the drive mode of the discharge lamp 10 are achieved, the influence of the occurrence of overshoot OS and undershoot US can be restrained and lighting control of the discharge lamp 10 can be properly carried out.

As described above, by carrying out the lighting control of the discharge lamp 10 according to the invention, it is possible to avoid the risk of blackening and coil breakdown or the like in the discharge lamp 10 due to the occurrence of overshoot OS and undershoot US and the risk of flickering in a projected image due to change in illuminance of the discharge lamp 10.

Therefore, the projector 1 can achieve further improvement in quality by having the discharge lamp lighting device 70 in which lighting control of the discharge lamp 10 can be properly carried out while the influence of the occurrence of overshoot OS and undershoot US is restrained.

The entire disclosure of Japanese Patent Application No. 2013-000368, filed Jan. 7, 2013 and Japanese Patent Application No. 2013-234709, filed Nov. 13, 2013 are expressly incorporated by reference herein.

What is claimed is:

1. A discharge lamp lighting device for controlling lighting of a discharge lamp, device comprising:

a drive unit that drives the discharge lamp; and a control unit that controls the drive unit;

wherein the control unit varies a current value of overshoot and undershoot generated in a waveform of a drive current that is applied when the drive unit drives the discharge lamp, at least according to a magnitude of drive power supplied to the discharge lamp.

2. The discharge lamp lighting device according to claim 1, wherein the control unit causes the current value of overshoot and undershoot to be relatively small when the drive power supplied to the discharge lamp is large, and causes the current value of overshoot and undershoot to be relatively large when the drive power supplied to the discharge lamp is small.

3. The discharge lamp lighting device according to claim 1, wherein the control unit varies the current value of overshoot and undershoot generated in the waveform of the drive current that is applied when the drive unit drives the discharge lamp, according to a drive mode of the discharge lamp.

4. The discharge lamp lighting device according to claim 3, wherein the control unit causes the current value of overshoot and undershoot to be relatively small when an average drive frequency of the discharge lamp is high, and causes the current value of overshoot and undershoot to be relatively large when the average drive frequency of the discharge lamp is low, according to the drive mode of the discharge lamp.

5. The discharge lamp lighting device according to claim 3, wherein the control unit causes the current value of overshoot and undershoot to be relatively large when a range of fluctuation in drive frequency of the discharge lamp is large, according to the drive mode of the discharge lamp.

6. The discharge lamp lighting device according to claim 3, wherein the control unit uses a current value obtained by multiplying the current value of overshoot and undershoot corresponding to the magnitude of the drive power supplied to the discharge lamp by a coefficient corresponding to the drive mode of the discharge lamp.

7. The discharge lamp lighting device according to claim 1, wherein the drive unit has a step-down chopper unit that lowers inputted DC power to a predetermined output voltage and outputs the resulting DC power, and a power conversion unit that converts the DC power supplied from the step-down chopper unit to AC power and outputs the resulting AC power, the step-down chopper unit outputs, based on a control signal from the control unit, DC power that is converted to an output voltage corresponding to a duty ratio of the control signal, and the control unit changes the duty ratio of the control signal during a predetermined period and thus varies the current value of overshoot and undershoot.

8. A discharge lamp lighting method for controlling lighting of a discharge lamp, the method comprising:

varying a current value of overshoot and undershoot generated in a waveform of a drive current that is applied when driving the discharge lamp, at least according to a magnitude of drive power supplied to the discharge lamp.

9. The discharge lamp lighting method according to claim 8, wherein the current value of overshoot and undershoot is made relatively small when the drive power supplied to the discharge lamp is large, whereas the current value of overshoot and undershoot is made relatively large when the drive power supplied to the discharge lamp is small.

10. The discharge lamp lighting method according to claim 8, wherein according to a drive mode of the discharge lamp, the current value of overshoot and undershoot generated in a waveform of a drive current thereof is varied.

11. The discharge lamp lighting method according to claim 10, wherein according to the drive mode of the discharge lamp, the current value of overshoot and undershoot is made relatively small when an average drive frequency of the discharge lamp is high, whereas the current value of overshoot and undershoot is made relatively large when the average drive frequency of the discharge lamp is low.

12. The discharge lamp lighting method according to claim 10, wherein according to the drive mode of the discharge lamp, the current value of overshoot and undershoot is made relatively large when a range of fluctuation in drive frequency of the discharge lamp is large.

13. The discharge lamp lighting method according to claim 10, wherein a current value obtained by multiplying the current value of overshoot and undershoot corresponding to the magnitude of the drive power supplied to the discharge lamp by a coefficient corresponding to the drive mode of the discharge lamp is used.

14. A projector comprising the discharge lamp lighting device according to claim 1.

15. A projector comprising the discharge lamp lighting device according to claim 2.

16. A projector comprising the discharge lamp lighting device according to claim 3.

17. A projector comprising the discharge lamp lighting device according to claim 4.

18. A projector comprising the discharge lamp lighting device according to claim 5.

19. A projector comprising the discharge lamp lighting device according to claim 6.

20. A projector comprising the discharge lamp lighting device according to claim 7.

* * * * *